US007757677B2

(12) United States Patent
Dobrila

(10) Patent No.: US 7,757,677 B2
(45) Date of Patent: Jul. 20, 2010

(54) EGR PULSE ATTENUATION

(75) Inventor: Laurentiu Dobrila, Cedar Falls, IA (US)

(73) Assignee: Deere & Company, Moline, IL (US)

( * ) Notice: Subject to any disclaimer, the term of this patent is extended or adjusted under 35 U.S.C. 154(b) by 116 days.

(21) Appl. No.: 11/948,597

(22) Filed: Nov. 30, 2007

(65) Prior Publication Data

US 2009/0139216 A1 Jun. 4, 2009

(51) Int. Cl.
*F02B 47/08* (2006.01)
*F02B 27/02* (2006.01)

(52) U.S. Cl. ..... 123/568.11; 60/312

(58) Field of Classification Search ..... 60/312; 123/568.11, 568.17; 181/238, 240, 257, 181/266, 270, 272, 276, 279, 280, 286
See application file for complete search history.

(56) References Cited

U.S. PATENT DOCUMENTS

| | | | | |
|---|---|---|---|---|
| 4,981,368 | A | 1/1991 | Smith | 366/337 |
| 5,408,978 | A | 4/1995 | Davis | 123/527 |
| 5,800,059 | A | 9/1998 | Cooke et al. | 366/337 |
| 6,425,382 | B1 | 7/2002 | Marthaler et al. | 123/568.17 |
| 6,633,646 | B1 * | 10/2003 | Hwang | 381/71.5 |
| 6,698,194 | B2 * | 3/2004 | Blair et al. | 60/314 |
| 6,799,423 | B2 * | 10/2004 | Piekarski | 60/313 |
| 6,811,302 | B2 | 11/2004 | Fleischli et al. | 366/174.1 |
| 6,945,235 | B1 * | 9/2005 | Bertilsson et al. | 123/568.11 |
| 7,090,048 | B2 * | 8/2006 | Albertson et al. | 181/240 |
| 7,140,357 | B2 | 11/2006 | Wei et al. | 123/568.17 |
| 7,357,125 | B2 * | 4/2008 | Kolavennu | 123/568.11 |
| 2005/0016792 | A1 * | 1/2005 | Graefenstein | 181/253 |
| 2005/0279569 | A1 * | 12/2005 | Harris | 181/250 |
| 2006/0162466 | A1 * | 7/2006 | Wargo et al. | 73/861.63 |
| 2008/0134678 | A1 * | 6/2008 | Noelle et al. | 60/605.2 |

* cited by examiner

*Primary Examiner*—Erick Solis
*Assistant Examiner*—David Hamaoui
(74) *Attorney, Agent, or Firm*—Taylor & Aust, P.C.

(57) ABSTRACT

A pulse attenuator for the EGR line of an internal combustion engine in which a main flow path has a pair of branch flow paths extending from the upstream portion of a venturi. The branch flow paths have a precisely determined length so as to reintroduce pulses back to the main flow path in a way that smoothes the flow. The pulses may be reconnected to the main flow path downstream of the point at which they are extracted or at the same point. The length of the branch passages may be different to provide attenuation of pulses at different engine rpms.

12 Claims, 5 Drawing Sheets

EGR PULSE ATTENUATION

FIELD OF THE INVENTION

The present invention relates to internal combustion engines, and more specifically to exhaust gas recirculation (EGR) systems for such engines.

BACKGROUND OF THE INVENTION

Exhaust gas recirculation has been employed since the mid 70's for air-breathing, spark ignition gasoline engines and since the early 2000's for heavy duty diesel engines. The purpose of EGR is to increase the nitrogen gas content in the combustible mixture to reduce combustion temperatures and accordingly the production of oxides of nitrogen which are considered to have harmful affect on the environment. A typical system involves a valve that allows a predetermined proportion of the exhaust gases to be directed to a mixer somewhere in the air inlet of the engine. Typically, a flow meter is incorporated in the system to more precisely control the flow of EGR relative to the air delivered to the inlet of the engine.

A problem with systems of this type is that internal combustion engines having multiple reciprocating pistons connected to a common exhaust manifold do not produce smooth uniform exhaust discharge, but rather a series of pulses that occur when the individual exhaust valve or valves are opened. Accordingly, the exhaust flow taken off for EGR is not a steady state stream but a series of pulses. When these pulses are directed to the engine air inlet they can be out of phase with the opening of the intake valves and cause an imbalance in the percentage of EGR between cylinders of the engine. Further, venturi flow meters operating on the Bernoulli Principle can have variations in results because of the pulsed rather than steady state flow through the meter.

Accordingly, a need exists in the art to provide relatively consistent and predictable EGR flow.

SUMMARY OF THE INVENTION

In one aspect, the invention involves a pulse attenuator for EGR flow including a main flow path and a branch passage connected to the main flow path and having a predetermined length and being reconnected to the main flow path. The length is selected to attenuate pulses within the main flow path.

In another aspect, the invention involves an engine system including an air breathing multi-cylinder reciprocating internal combustion engine having a common exhaust for products of combustion in pulses. EGR flow is directed from the exhaust to the air inlet of the engine. An EGR pulse attenuator is interposed in the EGR flow and includes a main flow path and at least one branch passage connected to the main flow path and having a predetermined length and being reconnected to the main flow path such that pulses are attenuated.

In yet another aspect of the invention, it includes a method having the steps of operating a reciprocating air breathing internal combustion engine having an exhaust for pulsed products of combustion. A predetermined proportion of the pulsed exhaust is directed from the exhaust. The directed portion is passed through a main flow path and a branch flow path having a predetermined length and reconnected to the main flow path so that pulses are attenuated. Finally, the EGR flow is mixed with inlet air for use by the internal combustion engine.

DETAILED DESCRIPTION OF THE INVENTION

Figure 1:
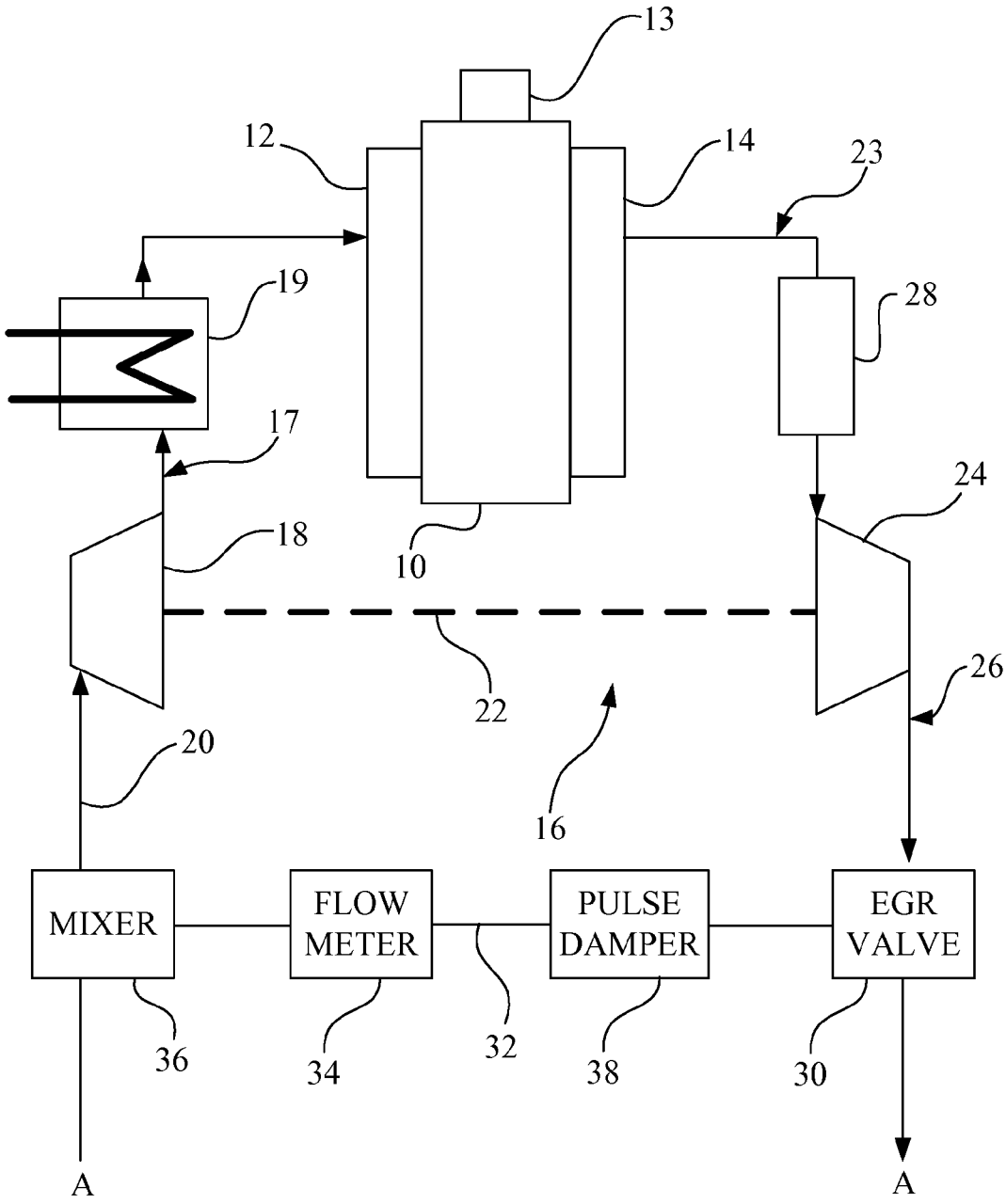
FIG. 1 shows in schematic fashion an internal combustion engine system embodying the present invention.

Referring to FIG. 1, there is shown an engine system including an internal combustion engine 10. Internal combustion engine 10 is of the reciprocating type where from one to as many as sixteen cylinders and more have reciprocating pistons within them, all connected to a common rotary output shaft. The engine 10 is an air breathing engine receiving air from a common intake 12. A fuel system 13 provides a controlled quantity and timing of fuel to the air received from intake manifold 12 to produce combustion. The engine cycle may be a compression ignition or diesel cycle in which the heat of compression of intake air from intake manifold 12 is sufficiently high that when fuel is injected into the cylinders from fuel system 13 the mixture ignites and produces combustion. The engine may also be a homogenous charge compression ignition engine (HCCI) in which all, or a portion of the fuel, is mixed with the air from intake manifold 12 before it enters the cylinders. In either case, the products of combustion are passed to an exhaust manifold 14 which in turn is connected to exhaust line 23. A particulate filter 28 is typically employed in line 23 to remove particulate matter from the exhaust stream. The filter may also include various means to remove oxides of nitrogen from the exhaust stream.

Although many engines have a turbocharger 16, it is not always necessary for operation of the inventive pulse attenuator. The turbocharger 16 has a turbine 24 that receives products of combustion and discharges them through a line 26 past an EGR valve 30 to the ambient A. The EGR valve 30 is adapted to open up an EGR line 32 extending to a mixer 36 where the EGR gases are appropriately mixed with ambient air A passing through inlet 20 to a compressor 18 driven by turbine 24 through an appropriate shaft 22. A flow meter 34 may be placed in EGR line 32 for control purposes. The output of compressor 18 is passed through a line 17 which typically incorporates an intercooler 19 and then connects with intake 12 to provide combustion air to engine 10 at a pressure level higher than ambient.

Figure 2:
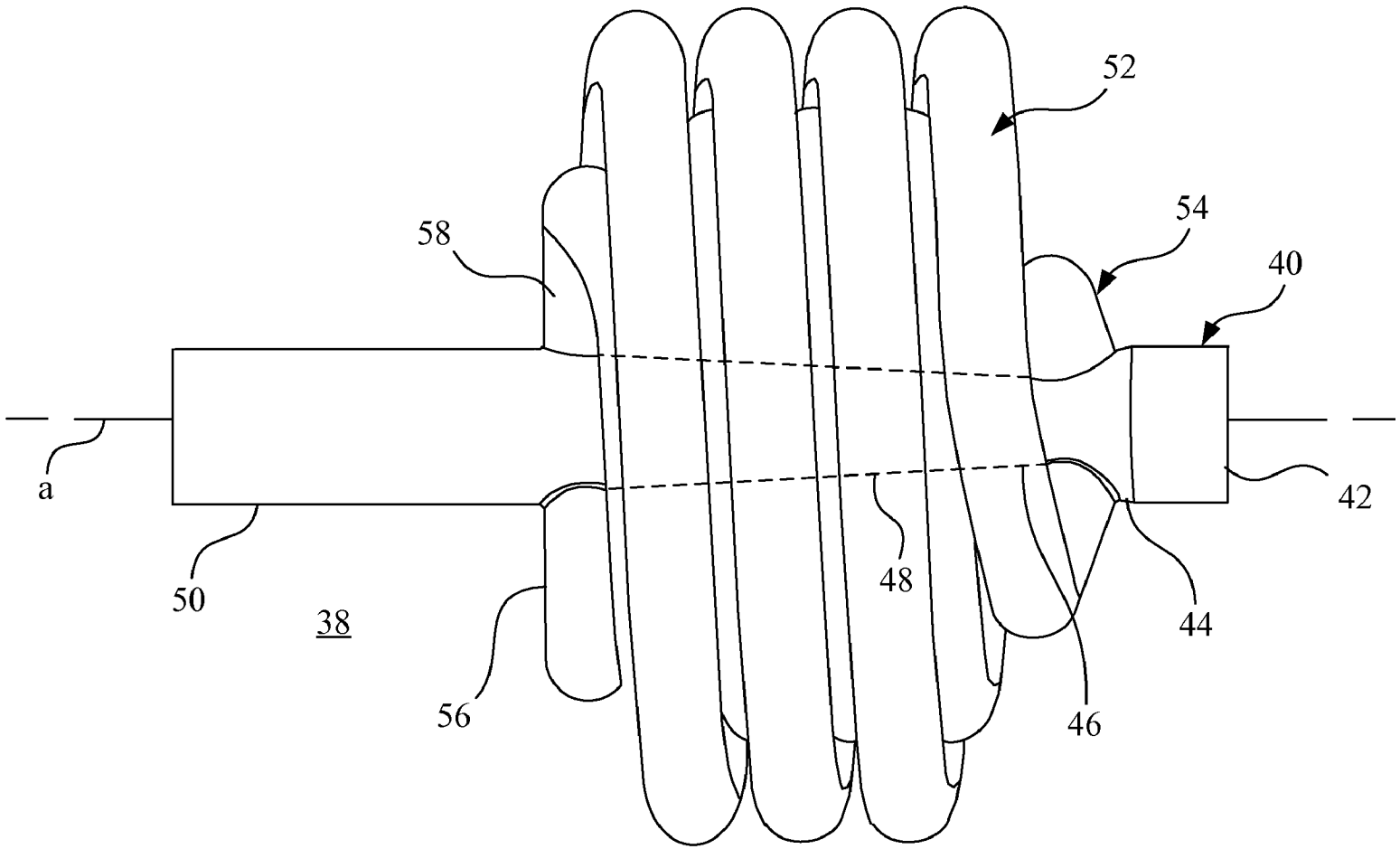
FIG. 2 is a side view of one embodiment of an EGR pulse attenuator incorporated in FIG. 1.

In order to attenuate the pulses in the EGR flow, a pulse attenuator 38 embodying the present invention is incorporated in line 32. The pulse attenuator 38 may take a number of forms, the first of which is shown in FIG. 2. Although the pulse attenuator 38 is shown between the EGR valve 30 and flow meter 34, it may be employed at any location in the EGR flow path, including upstream of the EGR valve 30.

Pulse attenuator 38 in FIG. 2 has a main flow path 40 interposed in EGR line 32 in a series connection. Flow path 40 has an inlet 42 leading to a convergent section 44, throat 46 and divergent section 48. Divergent section 48 leads to an outlet line 50 connected to the remainder of the EGR line. In accordance with the present invention, at least one branch flow path and, as illustrated, a pair of flow paths are provided through branch lines 52 and 54, respectively. Branch flow paths 52 and 54 connect to the main flow path 40 in the convergent section 44 and may have a tubular cross section and extend to outlets 56 and 58, respectively, in the outlet section 50. As herein shown, the branch passages 52 and 54 are spiral in configuration and wrap around the longitudinal axis a of main flow path 40. Furthermore, branch passages 52 and 54 have predetermined lengths that are selected to attenuate particular frequencies of pulses. As herein shown, the length of passage 52 is greater than the length of passage 54 in order to particularly attenuate pulses at different engine rpm's. When the pulses through the branch passages 52 and 54 pass to the outlet section 50, they arrive in between the pulses passing through the main flow path 40 with the ultimate affect of attenuating pulses that pass through the flow meter 34 and to the mixer 36. The lengths of passages 52 and 54 are selected so that pulses occurring at given rpms pass to the outlet section at the appropriate time. The length of the branch passage is determined using fluid dynamics principles and flow equations. For higher selected engine rpms, the overall length of the passages may be shorter than for lower rpms.

Figure 3:
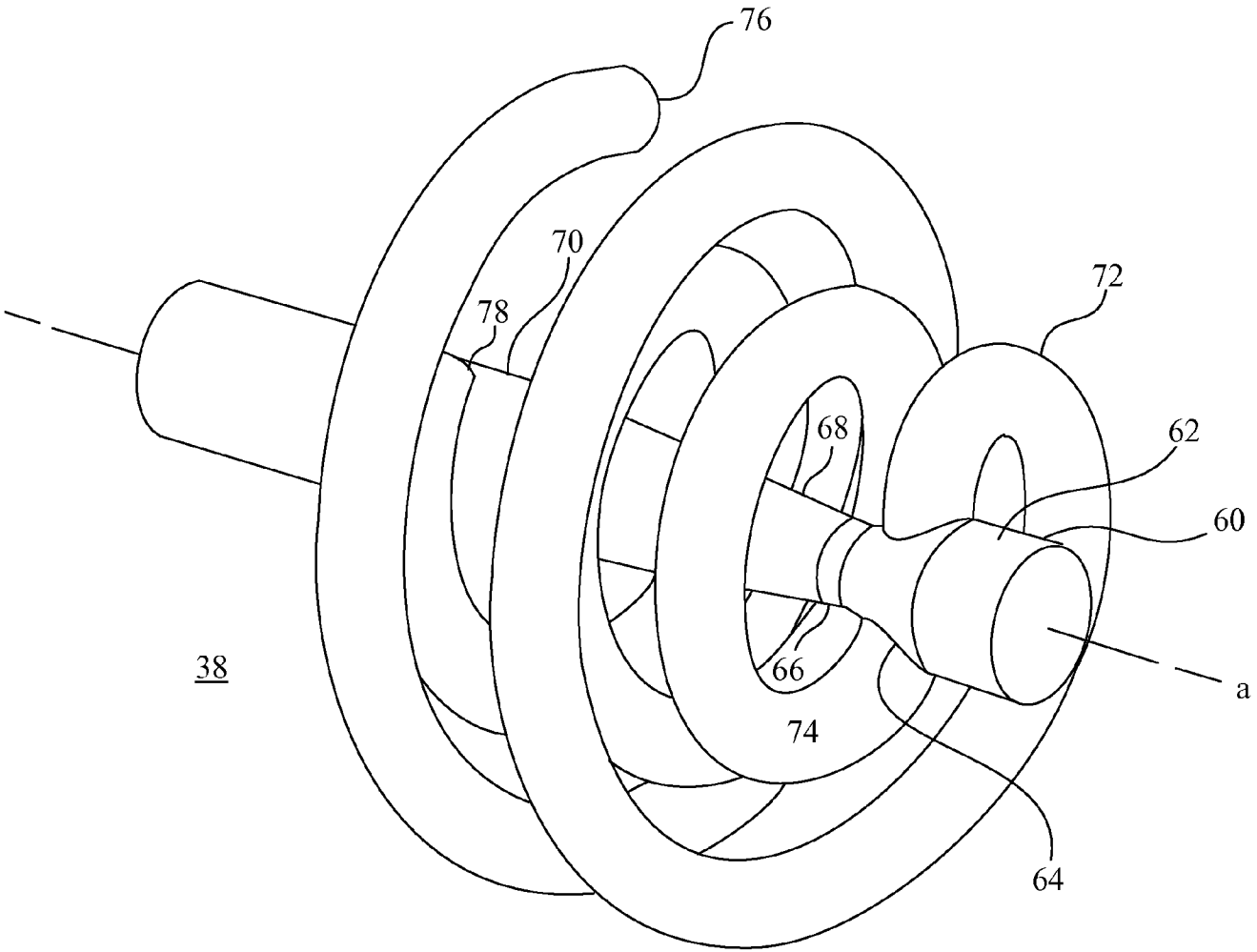
FIG. 3 is a perspective view of another EGR pulse attenuator incorporated in the engine system of FIG. 1.

The EGR pulse attenuator illustrated in FIG. 2 reconnects the branch passages 52 and 54 to the main flow path 40. However, the configuration shown in FIG. 3 has an arrangement where the branch passages are capped off to reflect pulses back to reconnect at the same point at which the branch passage connects to the main flow path. In FIG. 3, a main flow path 60 has an inlet 62, convergent section 64, throat 66 and divergent section 68 connecting to an outlet 70. Outlet 70 and inlet 62 would be interposed in EGR line 32. In this embodiment a first branch passage 72 and second branch passage 74 are connected to the convergent section 64. Branch passages 72 and 74 may be tubular in form and as illustrated wrap around the longitudinal axis a of main flow path 60 in a spiral fashion. Passage 72 has a capped end 76 and passage 74 has a capped end 78. The length of branch passages 72 and 74 is selected so as to cause pulses of particular frequency to the reflected back from end cap 76 and 78 to come back into the convergent section 64 in between pulses passing through from the inlet section 62. As illustrated, branch passage 72 has a greater length than branch passage 74 to reflect back pulses at different engine rpm's. Like the arrangement of FIG. 2, the pulses are timed to come back into the flow path 60 in between pulses in the main flow path so that the flow is smoothed out and made more consistent. By providing a re-connection to the main EGR flowpath after the divergent section, some of the pressure lost by the convergent section is recovered.

Figure 4:
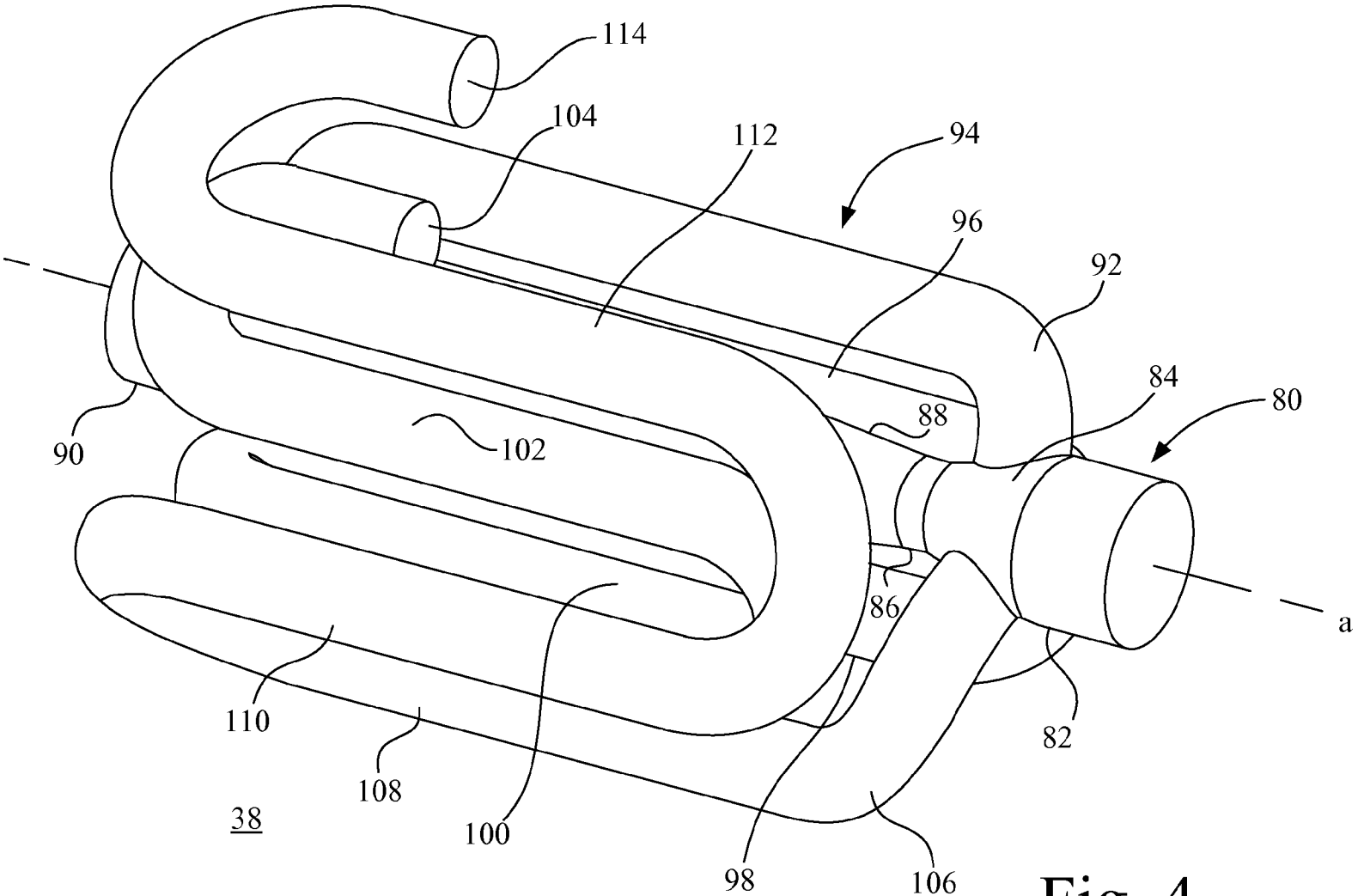
FIG. 4 is still another EGR pulse attenuator incorporated in the engine system of FIG. 1.

FIG. 4 shows still another version of the pulse attenuator 38 similar to the arrangement of FIG. 3 in which the ends of the branch passages are capped, but having an arrangement where a portion of the branch passages extend axially with respect to the longitudinal axis so as to minimize the overall diameter of the pulse attenuation device 38. In FIG. 4 a main flow path 80 is interposed in EGR line 32 and has an inlet section 82, convergent section 84, a throat 86, divergent section 88 and outlet 90.

A first branch passage 92 connects with convergent section 84 and may be tubular in form and having axially extending portions 94, 96, 98, 100 and 102. These axial portions are interconnected by generally 90° bends and 180° bends of the pipe. Branch passage 92 terminates with an end cap 104.

A second branch passage 106 also connects with the convergent section 84. Branch passage 106 has axial portions 108, 110 and 112 all extending generally parallel to the longitudinal axis a of the main flow passage 80. The axial portions 108, 110 and 112 are interconnected by various curved sections and branch passage 106*f* terminates with an end cap 114.

The principle of operation of the branch passages 92 and 106 is the same as those for FIG. 3 in which their length is precisely selected to have pulses passing back into the convergent section 84 at a timed interval to smooth flow. As is apparent from FIG. 4, the length of branch passage 92 is longer than that for branch passage 106 to provide timing of pulses for different engine rpms.

Figure 5:
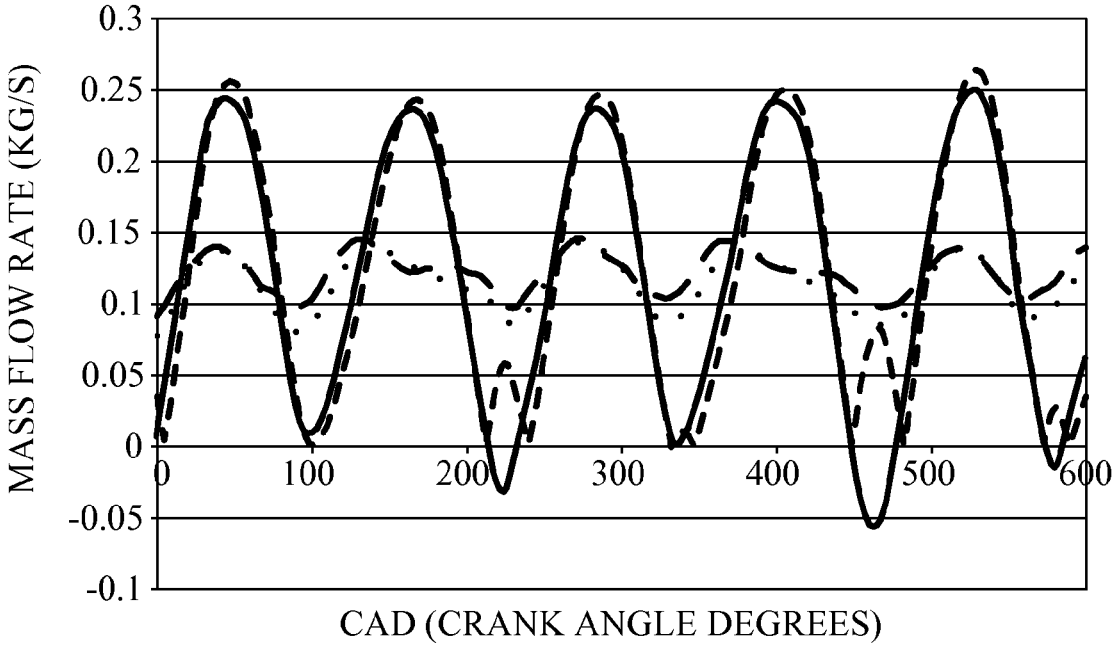
FIG. 5 is a graph of the EGR mass flow rate as affected by the present invention.

The operation of the pulse attenuators causes the flow through the EGR line 32 to be smooth thus enabling a reduction in the variation of cylinder to cylinder EGR percentage and a more simplified and accurate operating mode for the flow meter 34. The effect on the mass flow rate through the EGR path is shown in FIG. 5 where the peaks and valleys are smoothed to produce a substantially consistent flow.

Having described the preferred embodiment, it will become apparent that various modifications can be made without departing from the scope of the invention as defined in the accompanying claims.

The invention claimed is:

1. A flow attenuator for pulsed EGR flow, said attenuator comprising:

a primary flow passage for EGR flow;

at least one branch passage extending from and connected to said primary flow passage, said branch passage having a predetermined length to return EGR pulses to said primary flow passage out of phase with the pulses passing through said primary flow passage, wherein said primary flow passage has a venturi and said branch passage connects to an upstream portion of said venturi, thereby attenuating pulses passing through said primary flow passage.

2. The flow attenuator as claimed in claim 1, wherein said branch passage is curved.

3. The flow attenuator as claimed in claim 2, wherein said branch passage is in the form of a spiral around the longitudinal axis of said primary flow passage.

4. The flow attenuator as claimed in claim 1, wherein EGR pulses in said branch passage are returned to said primary flow passage at the same point at which they exit said primary flow passage.

5. The flow attenuator as claimed in claim 1, wherein said branch passage is in the form of a spiral generally around the longitudinal axis of said primary flow passage.

6. The flow attenuator as claimed in claim 1, having a plurality of branch passages each having different lengths so that pulses of different frequencies are damped out.

7. An engine system comprising:

an air breathing reciprocating internal combustion engine having an intake for combustion air and an exhaust for products of combustion in pulses;

an exhaust line for receiving products of combustion;

an EGR device having a primary flow passage connected to said exhaust line for passing a selected portion of the pulsed exhaust flow to said intake; and a plurality of branch passages extending from and connected to said primary flow passage, each said branch passages having different predetermined lengths to damp out frequency pulses at different engine rpm's to return EGR pulses to said primary flow passage out of phase with the pulses passing through said primary flow passage, thereby attenuating pulses passing through said primary flow passage.

8. The engine system as claimed in claim 7, wherein EGR pulses in said branch passage are returned to said primary flow path at the same point at which they exit said primary flow path.

9. The engine system as claimed in claim 8, wherein said branch passage is tubular in form and is in a spiral generally around the longitudinal axis of said primary flow path.

10. A method of attenuating EGR pulses in reciprocating internal combustion engine having an exhaust for pulsed products of combustion and an air intake, said method comprising the steps of:

extracting a selected portion of the pulsed products of combustion into a primary EGR flow path;

extracting a portion of the flow through multiple paths from said primary EGR flow path;

re-introducing the flow into said primary EGR flow path out of phase with the pulses in said primary EGR flow path; and providing the damped EGR flow to the air intake for said internal combustion engine.

11. The method as claimed in claim 10, wherein said extracted flow is re-introduced to said primary flow path at the same point at which it is extracted from said primary flow path.

12. The method as claimed in claim 10, wherein said extracted flow extends through different lengths to provide attenuation of different frequencies.

* * * * *